US006877451B2

(12) United States Patent
Rivas

(10) Patent No.: US 6,877,451 B2
(45) Date of Patent: Apr. 12, 2005

(54) REPLACEMENT RETAINING RING

(75) Inventor: Frank J. Rivas, Virginia Beach, VA (US)

(73) Assignee: Q.E.D. Systems, Inc., Virginia Beach, VA (US)

( * ) Notice: Subject to any disclaimer, the term of this patent is extended or adjusted under 35 U.S.C. 154(b) by 0 days.

(21) Appl. No.: 10/378,080

(22) Filed: Mar. 4, 2003

(65) Prior Publication Data

US 2004/0173136 A1 Sep. 9, 2004

(51) Int. Cl.[7] ..... B63B 19/26

(52) U.S. Cl. ..... 114/182; 114/85; 114/183 R; 210/164

(58) Field of Search ..... 114/182, 183 R, 114/185, 197, 198, 85, 184; 210/163–166; 4/286–292; 137/550; D23/260–262

(56) References Cited

U.S. PATENT DOCUMENTS 2,095,024 A * 10/1937 Boosey ..... 210/300
2,431,082 A * 11/1947 Sayles ..... 404/26
2,519,843 A * 8/1950 Matheis ..... 210/165
2,576,353 A * 11/1951 Walter ..... 210/251
2,695,678 A * 11/1954 Sisk ..... 210/165
2,749,999 A * 6/1956 Schmid ..... 210/165
2,783,852 A * 3/1957 Sisk ..... 210/165
2,948,399 A * 8/1960 Sisk ..... 210/166
3,040,895 A * 6/1962 Sisk ..... 210/164
3,212,416 A 10/1965 Boersma
3,674,149 A * 7/1972 Nelson ..... 210/163
3,742,525 A * 7/1973 Oropallo ..... 4/288
3,896,511 A * 7/1975 Cuschera ..... 4/288
4,092,745 A * 6/1978 Oropallo ..... 4/288
4,123,810 A * 11/1978 Oropallo ..... 4/288
4,296,778 A * 10/1981 Anderson ..... 137/433
4,655,913 A 4/1987 Boersma
5,575,903 A 11/1996 Kato
6,263,518 B1 7/2001 Magtanong
D461,233 S * 8/2002 Whalen ..... D23/261

FOREIGN PATENT DOCUMENTS

JP 03005291 A * 1/1991 ..... B63B/13/00

* cited by examiner

*Primary Examiner*—S. Joseph Morano
*Assistant Examiner*—Ajay Vasudeva
(74) *Attorney, Agent, or Firm*—Miles & Stockbridge P.C.; Edward J. Kondracki

(57) ABSTRACT

A deck drain replacement/repair assembly for marine vessels, and a method for repairing or replacing a drain strainer, are provided. A flanged retaining ring and a flanged drain strainer are provided, with the retaining ring being sized such that the flange thereof seats on a step present within a drain basket secured into the deck. The retaining ring is positioned by the flange, and is then secured to the drain basket. The drain strainer is then positioned atop the retaining ring and secured thereto with screws.

3 Claims, 4 Drawing Sheets

REPLACEMENT RETAINING RING

BACKGROUND OF THE INVENTION

1. Field of the Invention

The present invention relates to a deck drain replacement assembly for use in marine applications.

2. Description of Related Art

Drains are commonly found on the decks of military ships, to allow standing water and other liquids to drain from the surface of the deck. Such drains are generally provided with a drain strainer which spans the opening of the drain, and which is mounted substantially flush with the deck, so as to avoid the presence of protrusions or recesses on the surface of the deck. The drain strainer is commonly a disc having a pattern of perforations or other openings which permit liquid and small particles to pass therethrough, while presenting a physical barrier precluding larger objects from entering the drain. The drain strainer also provides continuity to the deck surface.

On U.S. military ships, a common deck drain construction (see FIG. 1) involves the provision of a drain basket 10, a peripheral flange 12 of which is secured flush with the deck surface DS, with the basket having a drain opening 14 of a predetermined size or diameter. In this known design, a plurality, usually three or four, lugs 16 are provided to extend radially inwardly from an inner surface 18 of the drain basket 10. Each of the lugs 16 has a substantially flat upper surface, and the collective upper surfaces substantially define a common plane located at a predetermined distance below the surface of the deck DS.

Each lug 16 is tapped to receive a retaining screw or bolt therein. A drain strainer 20 made of a solid disk of metal, and having the perforations or openings therein, is sized to reasonably closely fit the diameter of the opening defined by the drain basket 10. The drain strainer 20 is also of a thickness substantially equal to the distance at which the lugs 16 are recessed below the deck surface DS. Being sized in that manner, the drain strainer 20 will be received in drain basket 10, and the upper surface 21 of the drain strainer will lie substantially flush with the deck surface 100.

For the sake of complete accuracy, it is to be noted that the load bearing deck on the ship is usually coated with an approximately ½" thick deck covering, such as a terrazzo material or ceramic tile. The term "deck surface" as used herein will refer to the exposed surface, whether that be the steel load bearing elements, or the deck covering, where such a covering is employed. In the drawings, the deck is represented as a single layer, for purposes of simplicity.

The drain strainer 18 has a plurality of tapped or untapped bores 22 through which screw or bolt fasteners 24 can be introduced. The bores 22 are produced in the drain strainer 18 to align with the bores on lugs 16. The drain strainer is thus secured to the drain basket 10 by the plurality of fasteners 24.

This design is initially generally satisfactory. However, once the ship or craft has been put into service, it has proven to be difficult to maintain the drains in their original operating condition. A significant problem with the above design is that the fasteners (screws) corrode and strip out, thereby leaving the drain strainer 20 either unsecured or only partially secured, leading to potentially dangerous situations.

It is possible to replace an entire drain assembly, including the drain basket 10, however, this is a fairly costly endeavor, and the lead time for procuring the assembly can be extensive. Further, this replacement process, which involves welding or otherwise securing the flange of the drain basket to the deck, may not be suitable under the then prevailing conditions.

An attempt to address this problem has previously been proposed. A drain strainer repair kit has been developed and used, albeit with only limited success. The repair or replacement under this approach involves chiseling off, grinding off, or sawing off the lugs 16. It is to be noted, in this respect, that broken or malfunctioning lugs are also common in this shipboard environment. Once the lugs have been removed, a cylindrical brass ring insert 30 (FIG. 2), having an outer diameter substantially equal to the diameter of the opening in drain basket 10, is inserted into the drain basket.

It can be seen in FIG. 2 that, at the level at which the lugs 16 were previously provided, the wall thickness of the drain basket 10 increases in thickness, thereby leaving a small "step" 11 in the wall of the drain basket at that level. The brass ring insert 30 is sized to closely conform to the stepped-in wall section of the drain basket. The brass ring insert 30 is of sufficient thickness that bores 32 spanning the step 11 and the insert 30 can be produced once the insert is in place.

In this design, the brass ring insert 30 is intended to be lowered into and positioned within drain basket 10 such that an upper surface 31 thereof is positioned at the same level as the step 11, i.e., at the level at which the upper surfaces of lugs 16 were previously present. Once so positioned, a plurality of set screws or socket screws 34 are tightened through horizontal bores 36 extending through the wall of insert 30, into contact with the inner wall of drain basket 10, to retain the insert at this position.

A plurality of tapped bores 38 must then be produced at the juncture of the brass ring insert and stepped-in portion of the drain basket wall. In order to facilitate proper positioning of these bores, the drain strainer is usually placed in its operative position atop the insert, and the bores are then created through the openings in the drain strainer. The drain strainer is then secured in position by fasteners 24 (see FIG. 1).

This repair modification has significant drawbacks. It has proven to be fairly difficult to properly position brass ring insert 30 such that the upper surface of the insert is flush with the upper surface of step 11 of the drain basket. Often, the ring is slightly or significantly skewed or cocked, which results in the drain strainer that seats on the upper surface of the insert also being skewed or cocked, thus causing part of the drain strainer to either protrude above the level of the deck surface DS or to be recessed below the deck surface. In either case, a potentially dangerous situation is presented.

In addition, the requirement to create the tapped bores in situ adds considerable complexity to the process, particularly if the repair is to be conducted at sea. Furthermore, the bore is created an area at which two different elements made of two different materials abut against each other. This further complicates the process and can lead to an improper repair being performed. The drilling and tapping of the bores is also very time consuming, and shipboard personnel have thus, in many instances, opted to not perform the repair at sea, and instead allow the unsatisfactory situation to remain until the repair can be effected when the ship returns to port.

An attempted improvement on the above repair procedure has been proposed. In that proposal, a replacement drain strainer having fastener holes moved closer to center is provided, thus permitting the fastener retaining bores to be drilled and tapped only into the brass ring insert 3*a*. This proposed solution does not, however, eliminate the need to perform in situ drilling and tapping, nor does it address the problem of properly positioning and aligning the insert 30 in the drain basket 10.

It is therefore a principal object of the present invention to provide a repair/replacement assembly for marine deck drains which overcomes the aforenoted disadvantages.

SUMMARY OF THE INVENTION

The above and other objects of the present invention are achieved by providing a deck drain repair/replacement assembly that does not require the drilling or tapping of new bores in situ, and which avoids the noted problems with properly positioning the brass insert ring in the existing design.

The present invention calls for a flanged retaining ring to be secured in place within the drain basket, and a flanged drain strainer adapted to fit within the flanged retaining ring and to present an upper surface which is substantially flush with a deck surface. The flanged retaining ring is predrilled and tapped to receive fasteners for retaining the strainer, thus eliminating the need to conduct in situ drilling and tapping. The flange on the retaining ring rests or seats on the step in the drain basket, thereby eliminating the alignment problems experienced with the existing brass insert ring.

BRIEF DESCRIPTION OF THE DRAWINGS

These features and the attendant advantages will be better understood from the ensuing Detailed Description of the Preferred Embodiment, taken in conjunction with the drawings filed herewith, in which.

DETAILED DESCRIPTION OF THE PREFERRED EMBODIMENTS

Referring to all of FIGS. 3A, 3B, 4A, 4B and 5, a preferred embodiment of the deck drain repair/replacement assembly 100 of the present invention is illustrated.

Figure 1:
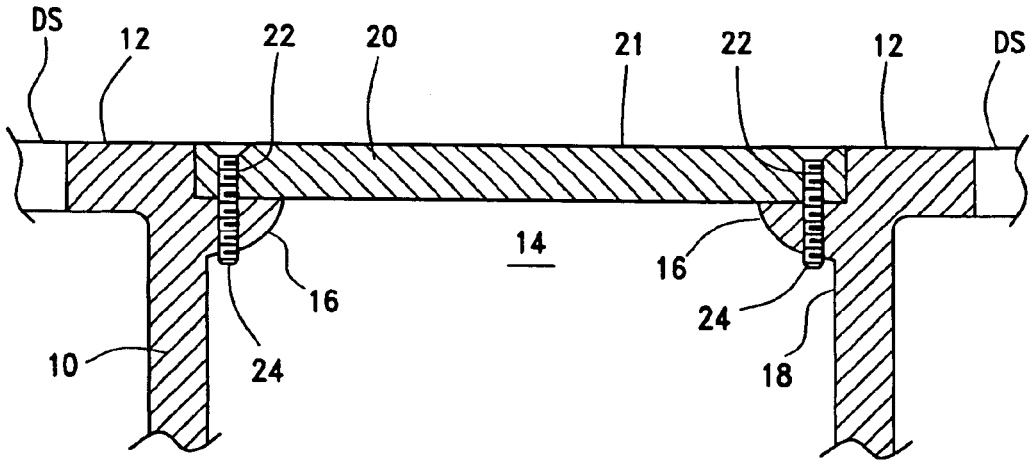
FIG. 1 (PRIOR ART)
FIG. 1 is a cross-sectional view of a deck drain construction as currently employed on military marine vessels.
Figure 2:
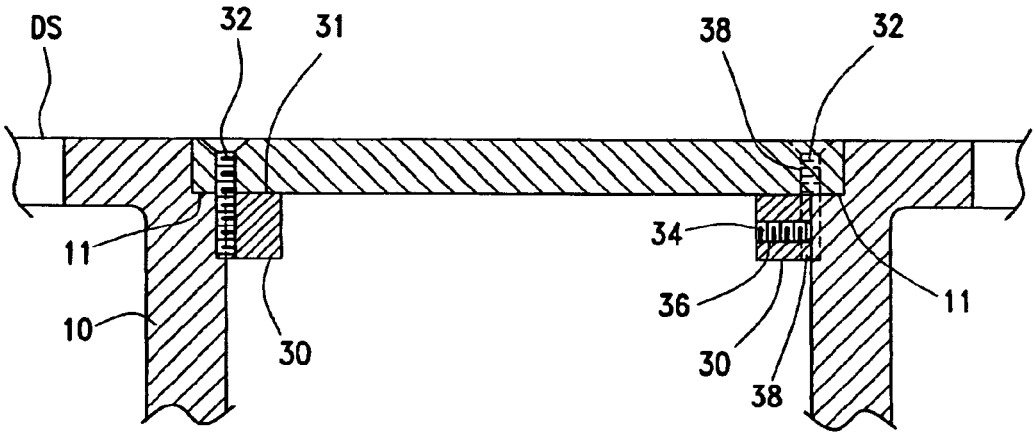
FIG. 2 (PRIOR ART)
FIG. 2 is a cross-section view of a deck drain repair assembly as previously used in repairing the FIG. 1 deck drain assembly.
Figure 3A:
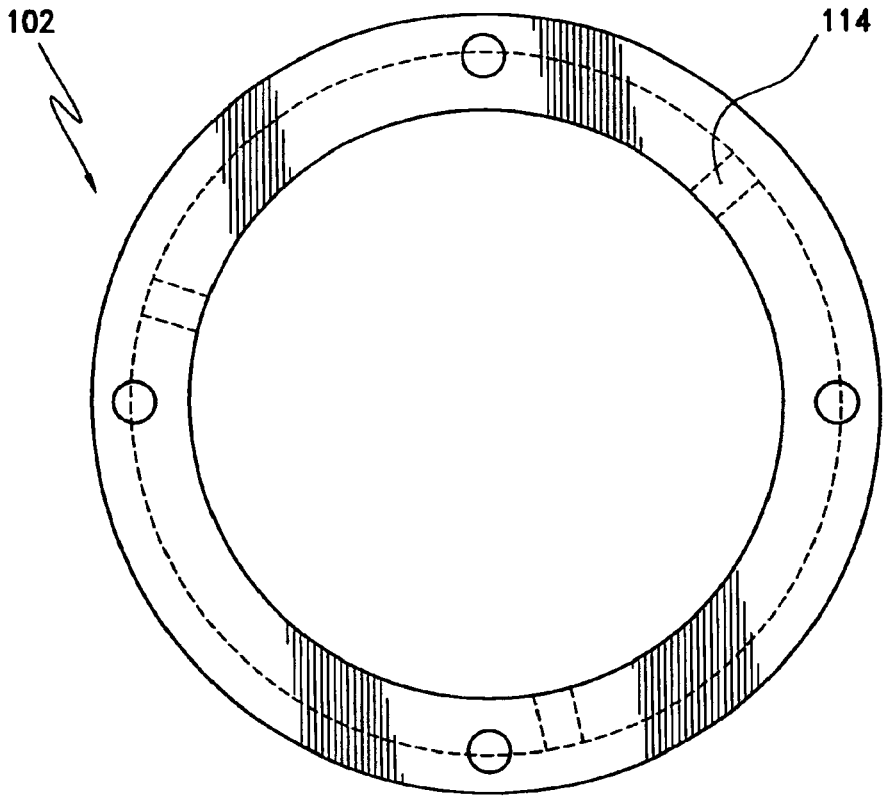
FIGS. 3A and 3B are top plan and side elevation views, respectively, of the flanged retaining ring of the present invention.
Figure 3B:
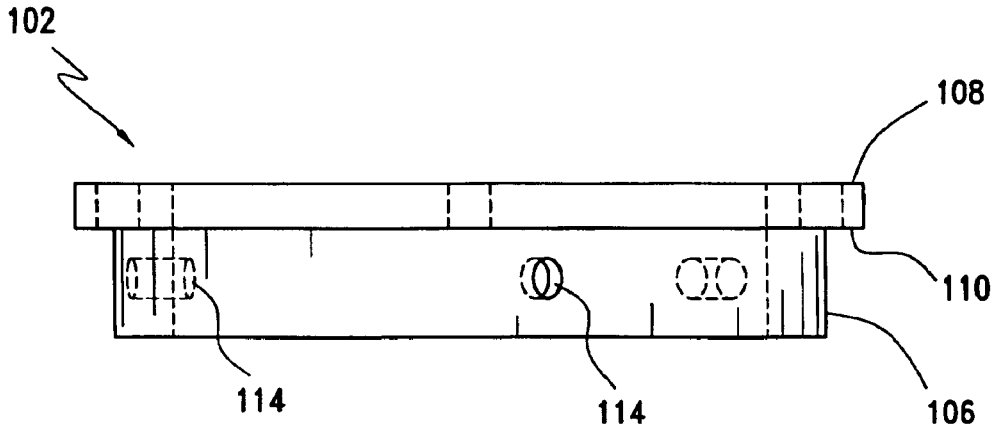

Assembly 100 includes a flanged retaining ring 102, as well as a flanged drain strainer 104. The flanged retaining ring 104 is sized such that the lower, unflanged, portion 106 thereof, can be inserted into the drain basket 10, once the lugs 16 (see FIG. 1) have been ground/chiseled/sawed off, as described previously with respect to the FIG. 2 repair approach. However, unlike the brass ring insert 30 employed in the FIG. 2 approach, which is inserted such that an upper surface thereof is flush or level with the upper surface of step portion 11 of the drain basket 10, the flange 108 is provided to protrude outwardly such that a lower surface 110 thereof engages the upper surface of step 11 (see FIG. 5).

This engagement of surfaces avoids the problems experienced in positioning and aligning the brass ring insert 30 in the prior approach. The design and sizing of flange 108 and step 11 essentially result in an automatic and very accurate positioning and alignment of the flanged retaining ring 102 within the drain basket 10. The flanged retaining ring 102 is preferably secured in this position by a plurality of set screws or socket screws 112 which are threaded through bores 114 extending substantially horizontally through the wall of lower portion 106, and into secure contact with the inner wall 13 of drain basket 10. This particular fastening aspect is similar to that employed with the FIG. 2 design.

Figure 4A:
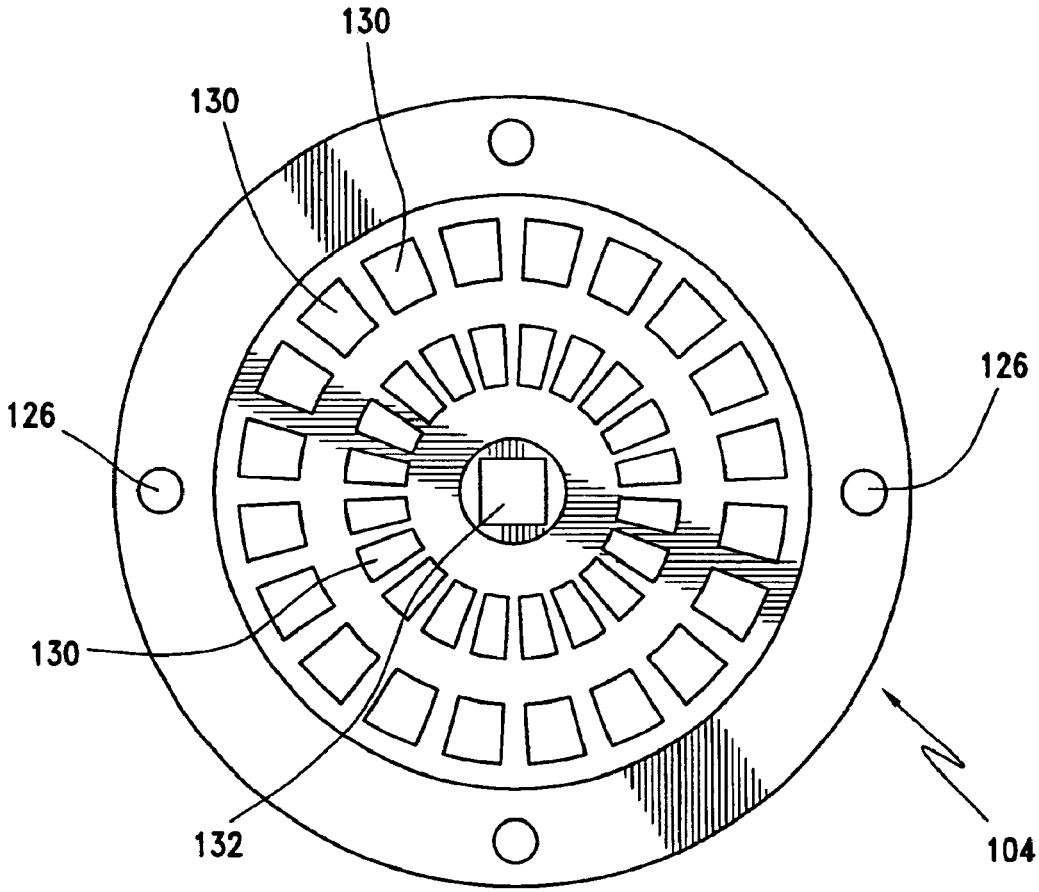
FIGS. 4A and 4B are top plan and side elevation views, respectively, of the flanged drain strainer of the present invention.
Figure 4B:
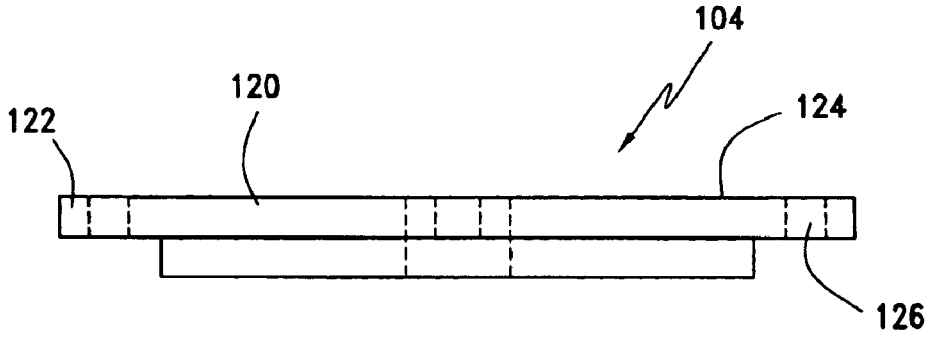
Figure 5:
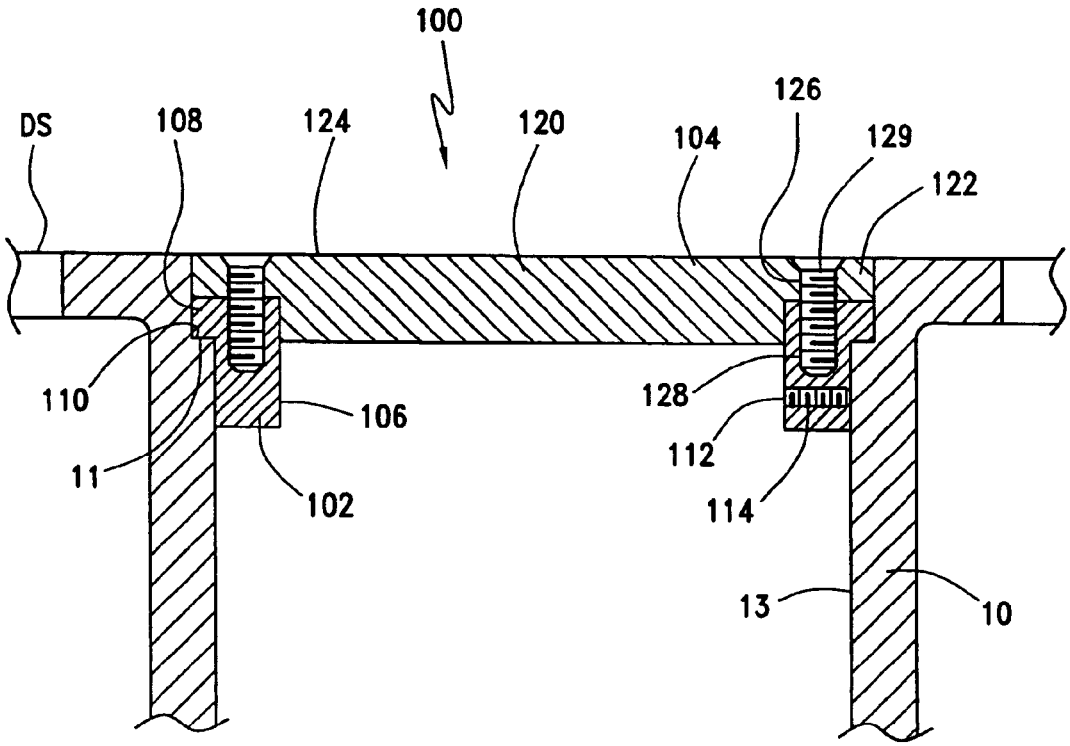
FIG. 5 is a cross-sectional view of the deck drain repair/replacement assembly installed in place according to a preferred embodiment of the present invention.

Once the flanged retaining ring 102 is secured in position, the drain strainer 104 may be installed. In the design of the present invention, because the flange 108 of flanged retaining ring 102 takes up a portion of the recessed area above step 11, the drain strainer 104 no longer has upper and lower substantially planar and parallel surfaces extending across the entire component. Instead, as seen in FIGS. 4A, 4B and 5, the drain strainer 104 has a preferably uniformly thick central section 120, and a thinner peripheral flange portion 122 surrounding the central section. This drain strainer design allows the strainer, once installed, to present an upper surface 124 that is substantially flush with the deck surface DS.

The drain strainer 104 is provided with a plurality of fastener openings 126 (four shown in FIG. 4A) that are positioned such that they are capable of being aligned with a plurality of tapped bores 128 that are provided in the flanged retaining ring 102. The fastener openings 126 are to be aligned with the tapped bores 128, and fasteners, preferably flat head screws 129, are tightened into the tapped bores to secure the drain strainer 104 in position. Because these two components will be more accurately and squarely positioned in the drain basket, the tapped bores 128 can be produced on the retaining ring at the time of its manufacture.

It will be understood, from viewing the illustration in FIG. 5, that the upper surface 124 of the drain strainer 104 will essentially automatically be properly positioned to provide a substantially flush surface with deck surface DS. The flanged retaining ring 102 can not be skewed or cocked out of alignment, due to its seating on step 11, and the same can be said for the seating of flange 122 of the drain strainer 104 onto the upper surface of flanged retaining ring 102.

The flanged retaining ring 102 may preferably be produced from a bronze alloy 932 cored rod stock, using known cutting and/or machining steps to produce the finished configuration. The drain strainer 104 may preferably be made of bronze material as well. The set screws 112 used to fasten the flanged retaining ring in place may preferably be cone-point stainless steel set screws.

As can be seen in FIG. 4A, the drain strainer 104 may be provided with a known pattern of openings 130 through which liquid may pass. Centrally located is a drain closure wrench socket 132. These aspects of the drain strainer are well known in the art.

There are several different standard drain sizes in use by military marine vessels, and the design of the present invention is readily adaptable to all such sizes. As but one illustrative example, one standard drain basket has an opening measuring $5\frac{11}{64}$" in diameter. The outer diameter of the flanged retaining ring 102 (including the flange) and the outer diameter of the drain strainer for this standard size will preferably be $5\frac{3}{16}$", leaving a $\frac{1}{64}$" total clearance for the parts to be inserted into the opening. The unflanged lower portion 106 of the retaining ring preferably has an outer diameter of $4\frac{11}{16}$", thereby allowing the lower portion 106 to be inserted past step 11, which will present an opening of about 5 1/16" or somewhat less, depending upon whether the lugs are completely removed.

The total height of the retaining ring 102 in this situation is preferably one inch and the height of flange 108 is preferably ¼ inch. Thus, the lower portion 106 extends downwardly for a distance of ¾ inch. The opening presented at the interior of retaining ring 102 is preferably 3 15/16 inch.

The drain strainer 104 in this size configuration has a ½ inch thick central section, with the lower portion having a diameter of 3⅞ inch, thereby allowing this lower portion to protrude into the central opening in retaining ring 102. The flange 108 is preferably ¼ inch thick and protrudes outwardly from the central section for a distance of 21/32 inch, with the total diameter thus being 5 3/16 inch.

It can be seen in FIG. 5, in particular, that the flanges of the retaining ring 102 and drain strainer 104 are preferably of a combined thickness, in this case, ½ inch, that is equal to the thickness of the original drain strainer that is being replaced by this assembly. This will allow the drain strainer 104 to be positioned at a level that is flush with deck surface DS.

Because the drain strainer will undergo loading periodically (being essentially a part of the deck surface), it is important that the repair/replacement assembly 100 be able to withstand such loads. It has been shown in initial testing that the design forming this invention is capable of withstanding the loads that would periodically be encountered on the deck of a ship.

Specifically for military ship (e.g., U.S. Navy) applications, components of this type are required to conform to the requirements of military specification MIL-S-901D (NAVY), titled, "Military Specification, Shock Tests, H.I. (High Impact); Shipboard Machinery, Equipment and Systems, Requirements for". In tests of a prototype deck drain assembly according to the present invention, conducted under this specification, the drain strainer and retaining ring were shown to withstand the applied shock/impact, and to thus conform to the requirements of the military specification.

The repair or replacement method according to the present invention involves removing, as necessary, any protrusions, such as lugs, from an inner wall of a drain basket 10, and positioning the flanged retaining ring 102 within the drain basket such that the flange 108 extending therefrom engages a step presented in the wall 13 of the drain basket. The flanged retaining ring is then secured in that position, preferably by set screws protruding through the lower part of the ring and into secure contact with the inner wall of the drain basket. The method then involves positioning a flanged drain strainer such that the flanged portion rests atop the upper surface of flange 108 of the flanged retaining ring 102, and aligning fastener openings extending through the flanged portion of the drain strainer with tapped bores extending through the flanged retaining ring. Once so aligned, suitable fasteners are inserted into the aligned openings and tightened therein.

The foregoing detailed description of the invention is provided for illustrative purposes only. Variations and modifications may become apparent to persons of ordinary skill in the art upon reading the above description and reviewing the drawings. The scope of the invention herein is thus to be determined by the claims.

What is claimed is:

1. A deck drain assembly for marine vessels, comprising:

a drain basket adapted to be secured to a deck of a marine vessel, having a central opening therein, an upper portion of said central opening being of a first predetermined diameter, and a lower portion immediately below said upper portion being of a second predetermined diameter smaller than said first predetermined diameter, thereby producing a steo portion at a level where said upper portion and said lower portion meet;

a retaining ring having an upper flanged portion and a lower unflanged portion, the upper and lower portions being sized such that said lower portion is capable of being inserted axially past said step presented in said drain basket secured to a deck of a marine vessel, and such that the flange of said upper portion is operable to rest upon said step in said drain basket, said retaining ring having an opening through a center thereof;

a drain strainer element having a central section and a flange protruding radially outwardly from said central section at an upper portion thereof, said central section being sized to fit into said opening in said retaining ring, and said flange being sized to engage an upper surface of said retaining ring;

means for securing said retaining ring to said drain basket;

means for securing said drain strainer to said retaining ring; and wherein said retaining ring securing means comprises a plurality of spaced apart threaded openings extending radially through a wall of said lower portion of said retaining ring, and a corresponding plurality of set screws adapted to be threaded therethrough and into contact with an inner wall of said drain basket.

2. A method for repairing a deck drain assembly installed on a deck of a marine vessel comprising:

removing an existing drain strainer from a drain basket to which said drain strainer is attached;

producing a substantially circular opening in a lower portion of said drain basket that is of a smaller diameter than a diameter of an opening at an upper portion of said drain basket, to produce a step portion;

inserting a flanged retaining ring into said drain basket such that a flange of said retaining ring rests upon the step portion of the drain basket, and such that a lower portion of said retaining ring extends downwardly from said flange adjacent an inner wall of said lower portion of said drain basket;

securing said retaining ring to said drain basket;

positioning a flanged drain strainer on said retaining ring, an outer portion of said drain strainer engaging an upper surface of said retaining ring, and wherein a height of said outer portion of said drain strainer and a height of said flange of said retaining ring are selected such that an upper surface of said drain strainer is substantially flush with a deck to which said drain basket is secured;

securing said drain strainer to said retaining ring; and wherein the step of producing said substantially circular opening in said lower portion of said drain basket comprises removing one or more protruding lugs present in the interior of said drain basket.

3. A method for repairing a deck drain assembly installed on a deck of a marine vessel comprising:

removing an existing drain strainer from a drain basket to which said drain strainer is attached;

producing a substantially circular opening in a lower portion of said drain basket that is of a smaller diameter than a diameter of an opening at an upper portion of said drain basket, to produce a step portion;

inserting a flanged retaining ring into said drain basket such that a flange of said retaining ring rests upon the step portion of the drain basket, and such that a lower portion of said retaining ring extends downwardly from said flange adjacent an inner wall of said lower portion of said drain basket;

securing said retaining ring to said drain basket;

positioning a flanged drain strainer on said retaining ring, an outer portion of said drain strainer engaging an upper surface of said retaining ring, and wherein a height of said outer portion of said drain strainer and a height of said flange of said retaining ring are selected such that an upper surface of said drain strainer is substantially flush with a deck to which said drain basket is secured;

securing said drain strainer to said retaining ring; and wherein said step of securing said retaining ring to said drain basket comprises tightening a plurality of set screws extending radially through openings in a wall of said lower portion of said retaining ring, such that said set screws securely engage a wall of the lower portion of the drain basket.

* * * * *

UNITED STATES PATENT AND TRADEMARK OFFICE

CERTIFICATE OF CORRECTION

PATENT NO. : 6,877,451 B2
DATED : April 12, 2005
INVENTOR(S) : Frank J. Rivas

It is certified that error appears in the above-identified patent and that said Letters Patent is hereby corrected as shown below:

Column 6,
Line 5, please delete "steo" and replace with -- step --.

Signed and Sealed this

Ninth Day of August, 2005

JON W. DUDAS
*Director of the United States Patent and Trademark Office*